United States Patent [19]

Eck et al.

[11] Patent Number: 4,886,242

[45] Date of Patent: Dec. 12, 1989

[54] PNEUMATIC HYDRAULIC SIDE LIFTING JACK

[75] Inventors: Leonard Eck, McPherson, Kans.; Reinald D. Liegel; Charles Naber, both of Waukesha, Wis.; Garry J. Sabel, South Milwaukee, Wis.

[73] Assignee: Hein-Werner Corporation, Waukesha, Wis.

[21] Appl. No.: 250,772

[22] Filed: Sep. 28, 1988

[51] Int. Cl.[4] ..... B66F 3/00

[52] U.S. Cl. ..... 254/8 B

[58] Field of Search ..... 254/3 R, 3 B, 3 C, 8 R, 254/8 B, 8 C, 2 R, 2 B, 1 C, 133, 134, 124, 126; 414/678

[56] References Cited

U.S. PATENT DOCUMENTS

| | | | |
|---|---|---|---|
| 815,757 | 3/1906 | Stark . | |
| 867,549 | 10/1907 | Bentley et al. . | |
| 2,165,095 | 7/1939 | Frechette | 254/2 B |
| 2,400,235 | 5/1946 | Johnson . | |
| 2,404,577 | 7/1946 | Jackson . | |
| 2,494,099 | 1/1950 | Mandelko et al. . | |
| 2,588,509 | 3/1952 | Forster . | |
| 2,611,579 | 9/1952 | Guzey et al. | 254/8 B |
| 2,730,903 | 1/1956 | Trautman et al. . | |
| 3,014,698 | 12/1961 | Arnes . | |
| 3,252,590 | 5/1966 | Nielsen . | |
| 3,268,208 | 8/1966 | Feilbach et al. . | |
| 3,302,927 | 2/1967 | Gray . | |
| 4,127,255 | 11/1978 | Wooding . | |
| 4,379,545 | 4/1983 | Gray et al. . | |

FOREIGN PATENT DOCUMENTS

| | | |
|---|---|---|
| 143755 | 10/1951 | Australia . |
| 1556608 | 11/1979 | Denmark . |
| 405664 | 7/1966 | Sweden . |
| 753786 | 8/1980 | U.S.S.R. . |

*Primary Examiner*—Robert C. Watson

*Attorney, Agent, or Firm*—Michael, Best & Friedrich

[57] ABSTRACT

A side lifting jack having a pneumatically and hydraulically actuated lifting cylinder for raising a lift arm of the side lifting jack. The jack includes a hydraulic fluid reservoir and air pressure is supplied to the hydraulic fluid reservoir to cause hydraulic fluid to be delivered to the lift cylinder. A flow restricting device controls the rate of flow of hydraulic fluid into or out of the hydraulic cylinder and prevents sudden movement of the jack or sudden extension of the lift cylinder assembly in the event that the load on the lift jack is suddenly reduced or removed from the lift jack. The jack also includes a ratch and pawl arrangement to selectively prevent retraction of the piston of the hydraulic cylinder and lowering of the jack.

31 Claims, 2 Drawing Sheets

PNEUMATIC HYDRAULIC SIDE LIFTING JACK

FIELD OF THE INVENTION

The invention relates to vehicle jacks and vehicle repair equipment, and more particularly to jack assemblies used in raising one side of a vehicle.

BACKGROUND PRIOR ART

An example of a prior art side lifting jack is illustrated in the Gray et al. U.S. Pat. No. 4,379,545, issued Apr. 12, 1983. Attention is also directed to the Nielsen U.S. Pat. No. 3,252,590, issued May 24, 1966; the Gray U.S. Pat. No. 3,302,927, issued Feb. 7, 1967 and Australian Patent Specification No. 143,755.

Attention is also directed to British Patent No. 1 556 608; Russian Publication No. 753785; Russian Publication No. 753786; the Wooding U.S. Pat. No. 4,127,255, issued Nov. 28, 1978; and the Feilbach et al. U.S. Pat. No. 3,268,208, issued Aug. 23, 1966. Attention is further directed to the Arnes U.S. Pat. No. 3,014,698, issued Dec. 26, 1961; the Trautman et al. U.S. Pat. No. 2,730,903, issued Jan. 17, 1956; the Forster U.S. Pat. No. 2,588,509, issued Mar. 11, 1952: the Mandelko et al. U.S. Pat. No. 2,494,099, issued Jan. 10, 1950; the Johnson U.S. Pat. No. 2,400,235, issued May 14, 1946; the Bentley U.S. Pat. No. 867,549, issued Oct. 1, 1907; the Stark U.S. Pat. No. 815,757, issued Mar. 20, 1906; Swiss Patent No. 405 664; and the Jackson U.S. Pat. No. 2,404,577, issued July 23, 1946.

SUMMARY OF THE INVENTION

The present invention provides an improved side lifting jack having a pneumatically and hydraulically actuated lifting cylinder for raising a lift arm of the side lifting jack. The jack includes a hydraulic fluid reservoir and means for supplying air pressure to the hydraulic fluid reservoir to cause hydraulic fluid to be delivered to the lift cylinder. The lifting jack further includes a flow restricting device to control flow of hydraulic fluid into or out of the hydraulic cylinder and thereby prevent sudden movement of the jack or sudden extension of the lift cylinder assembly in the event that the load on the lift jack is suddenly reduced or removed from the lift jack. The jack further includes a ratch and pawl arrangement to selectively prevent retraction of the piston of the hydraulic cylinder and lowering of the vehicle in the event of failure of the hydraulic cylinder.

More particularly, the invention includes a side lifting jack for lifting a vehicle and including a lift arm having one end supported by at least one wheel and the other end adapted to extend under a vehicle, and jack means for supporting the other end of the lift arm, the jack means including a hydraulic cylinder and an extensible piston housed in the hydraulic cylinder, and one of the cylinder and the piston being connected to the other end of the lift arm for raising the other end of the lift arm in response to extension of the hydraulic cylinder. In one embodiment of the invention the lift arm includes a hydraulic fluid reservoir, and means are also provided for connecting a source of air pressure to the hydraulic fluid reservoir. Means are also provided for connecting the hydraulic fluid reservoir in the lift arm to the hydraulic cylinder such that hydraulic fluid can be supplied from the fluid reservoir to the hydraulic cylinder when air pressure is applied to the hydraulic fluid reservoir.

In a preferred embodiment of the invention means are further provided for selectively locking the piston in a selected extended position, this locking means including a plurality of stop members fixed to the piston and spaced apart along the length of the piston, and a pawl supported by the cylinder and selectively engageable with a selected one of the stop members, the pawl being supported for movement between an engaging position wherein the pawl prevents retraction of the piston into the cylinder and a pawl retracted position wherein the pawl is spaced from the stop members, and the piston is freely movable with respect to the cylinder.

In one embodiment of the invention the hydraulic cylinder is supported by the piston for vertical movement in response to extension of the piston, and means are further provided for pivotally joining the other end of the lift arm to the lower end of the cylinder to permit relative pivotal movement of the cylinder with respect to the lift arm as the cylinder extends and retracts. This relative pivotal movement eliminates side loading on the components of the lifting jack and also permits the lifting jack components to follow the arc of the side of the vehicle during the lifting and retracting operations.

Various other features and advantages of the invention will be apparent by reference to the following description of a preferred embodiment, from the drawings and from the claims.

Figure 2:
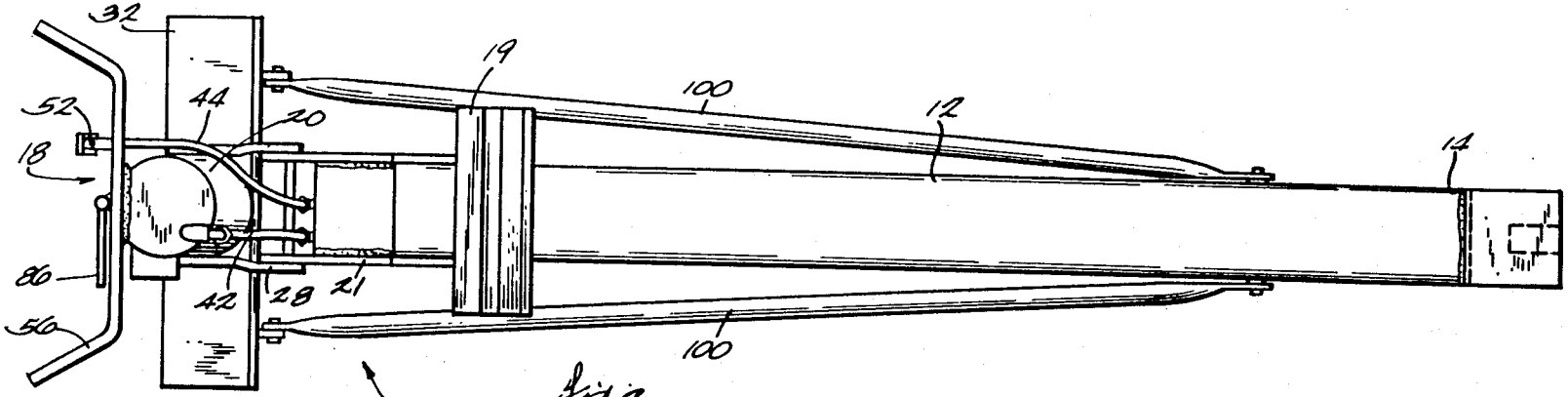
FIG. 2 is an elevation view of the side lift jack illustrated in FIG. 1.
Figure 6:
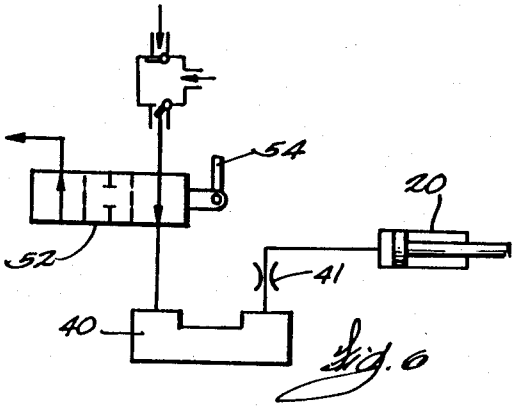
FIG. 6 is a schematic view of the hydraulic and pneumatic circuit of the side lift jack shown in FIGS. 1–5.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 1:
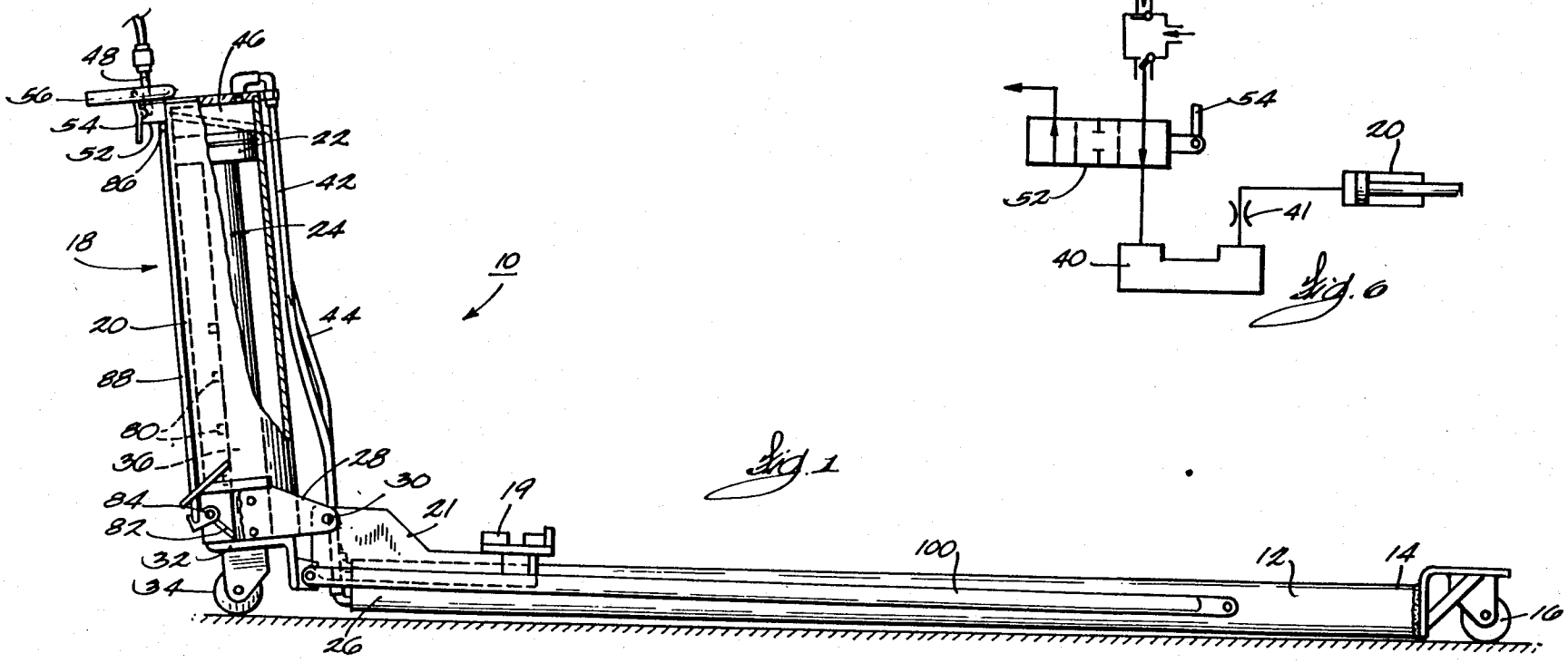
FIG. 1 is a side elevation view of a side lift jack embodying the invention and with portions broken away.
Figures 3, 4, 5:
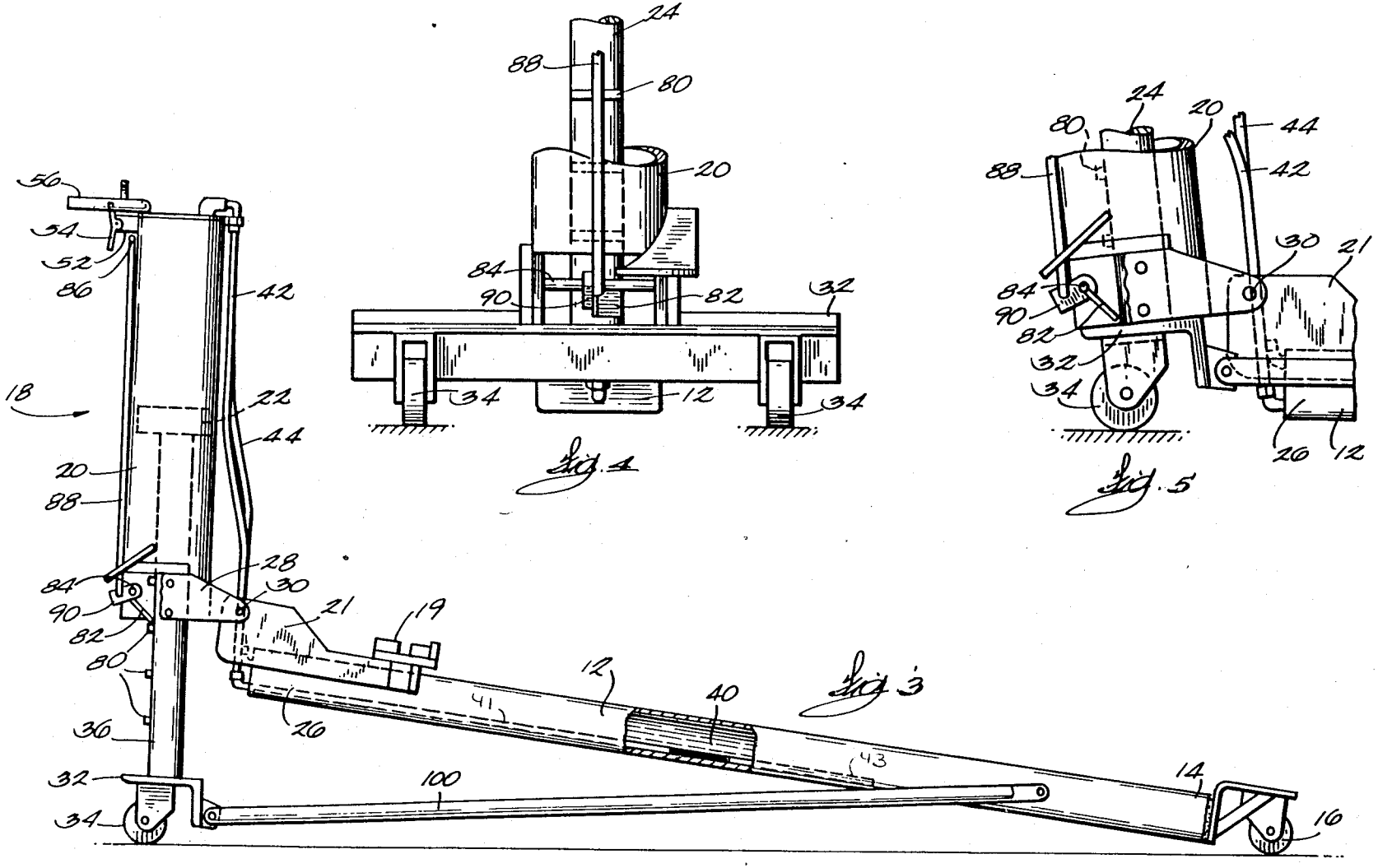
FIG. 3 is a view similar to FIG. 1 and showing the side lift jack in elevated condition.
FIG. 4 is an enlarged partial end elevation view of the lift jack illustrated in FIGS. 1 through 3.
FIG. 5 is an enlarged partial view of a portion of the side lift jack illustrated in FIG. 1.

Illustrated in FIG. 1 is a side lifting jack 10 embodying the invention and for use in lifting one side of a vehicle (not shown) to permit repair or maintenance work on the vehicle. The side lifting jack includes a lift arm 12 having opposite ends, one end 14 being supported by a caster or wheel 16 and adapted to extend under a vehicle. In a preferred form of the invention, the lift arm 12 will have a length of at least approximately two-thirds the width of the vehicle to be lifted. The opposite end of the lift arm 12 includes a transversely extending vehicle support member 19 adapted to be positioned beneath a side of a vehicle or beneath a side portion of a vehicle frame to engage the vehicle and for lifting the side of the vehicle. The vehicle support member 19 is supported by a pair of parallel, spaced apart, generally vertical plates 21 projecting upwardly from the end of the lift arm and fixed to the lift arm. While the saddle 19 could have other construction in the specific arrangement illustrated in the drawings, the saddle 19 has a configuration adapted to house and retain the pinch weld of an automobile.

The opposite end of the lift arm 12 is supported by a piston and cylinder assembly 18 including a generally vertically oriented cylinder 20 and piston 22 having a downwardly extending piston rod 24. In the illustrated arrangement, the hydraulic cylinder 20 is supported by the downwardly extending piston 22 for generally vertical movement, and the cylinder 20 includes a lower end pivotally joined to the opposite end 26 of the lift arm 12. More particularly, a bracket 28 is fixed to the lower end of the cylinder 20, and the vertical plates 21 fixed to the end 26 of the lift arm 12 are connected to the bracket 28 by a hinge pin or connecting pin 30.

The side lifting jack 10 also includes a base 32 which in the particular arrangement illustrated in the drawings is comprised of an elongated bar or angle having opposite ends supported by spaced apart casters 34.

The piston rod 24 of the piston and cylinder assembly 18 includes a lower end 36 fixed to the bar 32 intermediate its opposite ends and such that the lower end 36 of the piston rod 24 is supported by the bar 32.

In a preferred form of the invention the lift arm 12 comprises an elongated tank defining a hydraulic fluid reservoir 40 of sufficient volume that the tank can house sufficient hydraulic fluid to be supplied to the hydraulic cylinder 20. In a preferred form of the invention the fluid reservoir 40 is operably connected to the upper end of the hydraulic cylinder through hydraulic fluid line 42. Fluid line 42 comprises a supply line for delivering hydraulic fluid from the reservoir 40 to a chamber 46 defined by the upper end of the cylinder 20. Means are also provided for supplying air under pressure to the hydraulic fluid reservoir 40. In the illustrated arrangement this means for supplying air to the hydraulic fluid reservoir includes a coupling 48 and an air hose 44 extending from the coupling 48 to the hydraulic fluid reservoir. In one form of the invention the coupling 48 can comprise a conventional quick disconnect coupling for an air hose of the type commonly included in auto repair facilities and service areas.

In a preferred form of the invention, the hydraulic fluid used in the side lifting jack of the invention will be synthetic hydraulic fluid or oil which will not mix with air in the system. One hydraulic fluid which can be used is synthetic hydraulic fluid manufactured by Ams/Oil, Inc., Superior, Wisconsin.

As illustrated in FIG. 1, means are further provided for restricting the rate of flow of hydraulic fluid between the reservoir 40 and the hydraulic cylinder 20. While in other embodiments, other flow restricting means could be provided, in the illustrated arrangement the flow restricting means comprises and elongated tube 41 having a small diameter interior bore, the elongated tube being housed in the reservoir and having an open end 43. In the illustrated arrangement the tube has a length of approximately 58 inches and an internal bore diameter of 0.493 inches. This arrangement is effective to limit the flow of hydraulic fluid through the fluid line 42 and thereby limits the rate of flow of hydraulic fluid from the reservoir 40 to the cylinder 20 and thereby controlling the rate of vertical lift of the cylinder 20.

Also included is a manually operable control valve 52 for controlling the air pressure supplied by line 44 to the hydraulic fluid reservoir to provide for raising and lowering of the side lifting jack. In the illustrated arrangement, the manually operable valve 52 is controlled by a control lever 54. The control lever 54 and valve 52 are operable to permit the operator to increase the air pressure in the hydraulic fluid reservoir 40 thereby forcing hydraulic fluid into the cylinder to raise cylinder 20 or venting air pressure from the reservoir 40 permitting flow of hydraulic fluid out of the cylinder to the reservoir and lowering of the lift jack.

Means are also provided for selectively mechanically supporting the cylinder 20 in a raised position, this means including a plurality of mechanical stops 80 fixed to the piston rod 24 and spaced along its length. A pawl 82 is supported by the lower end of the cylinder 20 and selectively engages a selected one of the stops 80 when the piston 22 is extended and the cylinder 20 is raised. The pawl 82 is supported by a pivot pin 84 and pivots between a disengaged position and a stop or engaging position. A handle 86 is connected to the pawl by a connecting rod 88 and a bracket 90. In the illustrated arrangement the pawl 82 is mounted eccentrically with respect to the pivot pin 84, and the weight of the pawl 82, the connecting rod 88 and handle 86 tend to bias the pawl toward a stop engaging position.

During operation of the lift jack 10, the pawl 82 and stop members 80 selectively prevent downward movement of the cylinder 20 and lift arm 12. Lowering of the lift jack requires the operator to grip the handle 86 to disengage the pawl 82 and also actuate the valve 52 to first raise the cylinder slightly to permit disengagement with the pawl with the stop member and then actuation of the valve to lower the lift arm.

The side lifting jack also includes a pair of elongated braces 100, each of the braces 100 having one end pivotally connected to the inwardly extending end 14 of the lift arm 12 and an opposite end pivotally connected to an end of the base member 32 to provide support between the inwardly extending end 14 of the lift arm 12 and the ends of the base 32.

Various features of the invention are set forth in the following claims.

We claim:

1. A side lifting jack for lifting a vehicle, the side lifting jack comprising:

a lift arm having opposite ends, one end of the lift arm being supported by at least one wheel, and the one end of the lift arm being adapted to extend under a vehicle, jack means for supporting the other end of the lift arm, the jack means including a hydraulic cylinder assembly including a hydraulic cylinder and an extensible piston housed in the hydraulic cylinder, the hydraulic cylinder assembly being generally vertically extensible, one of the cylinder and the piston being connected by a pivotal connection to the other end of the lift arm for raising the other end of the lift arm in response to extension of the hydraulic cylinder, and the other of the piston and cylinder including a lower end, and an elongated brace member having opposite ends, one of the opposite ends of the elongated brace being connected to said lower end of the other of the piston and cylinder, and the other of the opposite ends of the brace member being connected to the lift arm in spaced relation from the other end of the lift arm.

2. A side lifting jack as set forth in claim 1 wherein the lift arm includes a hydraulic fluid reservoir, and further including means for connecting a source of air pressure to the hydraulic fluid reservoir.

3. A side lifting jack as set forth in claim 2 and further including means for connecting the hydraulic fluid reservoir in the lift arm to the hydraulic cylinder whereby hydraulic fluid can be supplied from the fluid reservoir to the hydraulic cylinder when air pressure is applied to the hydraulic fluid reservoir.

4. A side lifting jack as set forth in claim 1 and further including means for selectively locking the piston in the selected extended position, the means for selectively locking including a plurality of stop members fixed to the piston and spaced apart along the length of the piston, and a pawl supported by the cylinder and selectively engageable with a selected one of the stop members.

5. A side lifting jack as set forth in claim 4 wherein the pawl is supported for movement between an engaging position wherein the pawl prevents retraction of the piston into the cylinder and a pawl retracted position wherein the pawl is spaced from the stop members and the piston is freely movable with respect to the cylinder.

6. A side lifting jack as set forth in claim 1 wherein the hydraulic cylinder has upper and lower ends, and wherein the hydraulic cylinder is supported by the piston for vertical movement in response to extension of the piston, the other end of the lift arm being pivotally connected to the lower end of the cylinder.

7. A side lifting jack as set forth in claim 1 and further including an elongated base having opposite ends, the elongated base extending generally transversely to the axis of the lift arm, wheels supporting opposite ends of the base, and the piston being connected to the base intermediate its opposite ends, one end of the elongated brace member being connected to one end of the lift arm and an opposite end connected to one of the opposite ends of the elongated base.

8. A side lifting jack as set forth in claim 1 and further including means for restricting flow of hydraulic fluid into the hydraulic cylinder, the means for restricting the flow including a flow restricting orifice adapted to limit the rate of flow of hydraulic fluid from the hydraulic fluid reservoir into the hydraulic cylinder.

9. A side lifting jack for lifting a vehicle, the side lifting jack comprising:

a lift arm having opposite ends, one end of the lift arm being supported by at least one wheel and the one end of the lift arm being adapted to extend under a vehicle, jack means for supporting the other end of the lift arm, the jack means including a cylinder assembly including a cylinder and an extensible piston housed in the cylinder, the cylinder assembly being generally vertically extensible, and one of the cylinder and the piston being pivotally connected to the other end of the lift arm for raising the other end of the lift arm in response to extension of the cylinder, and means for selectively locking the piston in the selected extended position, the means for selectively locking including a plurality of stop members fixed to the piston and spaced apart along the length of the piston, and a pawl supported by the cylinder and selectively engageable with a selected one of the stop members.

10. A side lifting jack as set forth in claim 9 wherein the pawl is supported for movement between an engaging position wherein the pawl prevents retraction of the piston into the cylinder and a pawl retracted position wherein the pawl is spaced from the stop members and the piston is freely movable with respect to the cylinder.

11. A side lifting jack as set forth in claim 9 wherein the hydraulic cylinder has upper and lower ends, and wherein the cylinder is supported by the piston for vertical movement in response to extension of the piston, and further including means for pivotally joining the other end of the lift arm to the lower end of the cylinder.

12. A side lifting jack as set forth in claim 9 and further including an elongated base having opposite ends, the elongated base extending generally transversely to the axis of the lift arm, wheels supporting opposite ends of the base, and the piston being connected to the base intermediate its opposite ends, brace means having opposite ends, one end connected to one end of the lift arm and an opposite end connected to one of the opposite ends of the elongated base.

13. A side lifting jack for lifting a vehicle, the side lifting jack comprising:

a lift arm having opposite ends, one end of the lift arm being supported by at least one wheel, and the one end of the lift arm being adapted to extend under a vehicle, and the lift arm including a hydraulic fluid reservoir, jack means for supporting the other end of the lift arm, the jack means including a hydraulic cylinder assembly including a hydraulic cylinder and an extensible piston housed in the hydraulic cylinder, the hydraulic cylinder assembly being generally vertically extensible, and one of the cylinder and the piston being connected to the other end of the lift arm for raising the other end of the lift arm and in response to extension of the hydraulic cylinder, and means for connecting a source of air pressure to the hydraulic fluid reservoir.

14. A side lifting jack as set forth in claim 13 and further including means for connecting the hydraulic fluid reservoir in the lift arm to the hydraulic cylinder whereby hydraulic fluid can be supplied from the fluid reservoir to the hydraulic cylinder when air pressure is applied to the hydraulic fluid reservoir.

15. A side lifting jack as set forth in claim 13 and further including means for selectively locking the piston in the selected extended position, the means for selectively locking including a plurality of stop members fixed to the piston and spaced apart along the length of the piston, and a pawl supported by the cylinder and selectively engageable with a selected one of the stop members.

16. A side lifting jack as set forth in claim 15 wherein the pawl is supported for movement between an engaging position wherein the pawl prevents retraction of the piston into the cylinder and a pawl retracted position wherein the pawl is spaced from the stop members and the piston is freely movable with respect to the cylinder.

17. A side lifting jack as set forth in claim 15 wherein the hydraulic cylinder is pivotally connected to the lift arm for lifting the lift arm in response to extension of the piston.

18. A side lifting jack as set forth in claim 13 wherein the hydraulic cylinder has upper and lower ends, and wherein the hydraulic cylinder is supported by the piston for vertical movement in response to extension of the piston, and further including means for pivotally joining the other end of the lift arm to the lower end of the cylinder.

19. A side lifting jack as set forth in claim 13 and further including an elongated base having opposite ends, the elongated base extending generally transversely to the axis of the lift arm, wheels supporting opposite ends of the base, and the piston being connected to the base intermediate its opposite ends, brace means having opposite ends, one end connected to one end of the lift arm and an opposite end connected to one of the opposite ends of the elongated base.

20. A side lifting jack as set forth in claim 13 and further including means for restricting flow of hydraulic fluid into the hydraulic cylinder, the means for restricting the flow including a flow restricting orifice adapted to limit the rate of flow of hydraulic fluid from the hydraulic fluid reservoir into the hydraulic cylinder.

21. A side lifting jack for lifting a vehicle, the side lifting jack comprising:

a lift arm having opposite ends, one end of the lift arm being supported by at least one wheel, and the one end of the lift arm being adapted to extend under a vehicle, jack means for supporting the other end of the lift arm, the jack means including a hydraulic cylinder assembly including a hydraulic cylinder and an extensible piston housed in the hydraulic cylinder, the hydraulic cylinder assembly being generally vertically extensible, and one of the cylinder and the piston being connected to the other end of the lift arm for raising the other end of the lift arm in response to extension of the hydraulic cylinder, and an elongated base having opposite ends, the elongated base extending generally transversely to the axis of the lift arm, wheels supporting opposite ends of the elongated base, and the piston being connected to the elongated base intermediate its opposite ends, brace means having opposite ends, one end connected to one of the opposite ends of the elongated base.

22. A side lifting jack as set forth in claim 21 wherein the lift arm includes a hydraulic fluid reservoir, and further including means for connecting a source of air pressure to the hydraulic fluid reservoir.

23. A side lifting jack as set forth in claim 21 and further including means for connecting the hydraulic fluid reservoir in the lift arm to the hydraulic cylinder whereby hydraulic fluid can be supplied from the fluid reservoir to the hydraulic cylinder when air pressure is applied to the hydraulic fluid reservoir.

24. A side lifting jack as set forth in claim 21 and further including means for selectively locking the piston in the selected extended position, the means for selectively locking including a plurality of stop members fixed to the piston and spaced apart along the length of the piston, and a pawl supported by the cylinder and selectively engageable with a selected one of the stop members.

25. A side lifting jack as set forth in claim 24 wherein the pawl is supported for movement between an engaging position wherein the pawl prevents retraction of the piston into the cylinder and a pawl retracted position wherein the pawl is spaced from the stop members and the piston is freely movable with respect to the cylinder.

26. A side lifting jack as set forth in claim 24 wherein the hydraulic cylinder is pivotally connected to th e lift arm for lifting the lift arm in response to extension of the piston.

27. A side lifting jack as set forth in claim 21 wherein the hydraulic cylinder has upper and lower ends, and wherein the hydraulic cylinder is supported by the piston for vertical movement in response to extension of the piston, and further including means for pivotally joining the other end of the lift arm to the lower end of the cylinder.

28. A side lifting jack as set forth in claim 21 and further including means for restricting flow of hydraulic fluid into the hydraulic cylinder, the means for restricting the flow including a flow restricting orifice adapted to limit the rate of flow of hydraulic fluid from the cylinder fluid reservoir into the hydraulic cylinder.

29. A side lifting jack for lifting a vehicle, the side lifting jack comprising:

a lift arm having opposite ends, one end of the lift arm being supported by at least o ne wheel and the one end of the lift arm being adapted to extend under a vehicle.

jack means for supporting the other end of the lift arm, the jack means including a cylinder assembly including a cylinder and an extensible piston housed in the cylinder, the cylinder assembly being generally vertically extensible, and one of the cylinder and the piston being connected to the other end of the lift arm for raising the other end of the lift arm in response to e extension of the cylinder.

means for selectively locking the piston in the selected extended position, the means for selectively locking including a plurality of stop members fixed to the piston and spaced apart along the length of the piston, and a pawl supported by the cylinder and selectively engageable with a selected one of the stop members, and an elongated base having opposite ends, the elongated base extending generally transversely to the axis of the lift arm, wheels supporting opposite ends of the base, and the piston being connected to the base intermediate its opposite ends, brace means having opposite ends, one end connected to one end of the lift arm and an opposite end connected to one of the opposite ends of the elongated base.

30. A side lifting jack as set forth in claim 29 wherein the pawl is supported for movement between an engaging position wherein the pawl prevents retraction of the piston into the cylinder and a pawl retracted position wherein the pawl is spaced from the stop members and the piston is freely movable with respect to the cylinder.

31. A side lifting jack as set forth in claim 29 wherein the hydraulic cylinder has upper and lower ends, and wherein the cylinder is supported by the piston for vertical movement in response to extension of the piston, and further including means for pivotally joining the other end of the lift arm to the lower end of the cylinder.

* * * * *